United States Patent [19]

Repp

[11] Patent Number: 4,477,046

[45] Date of Patent: Oct. 16, 1984

[54] APPARATUS FOR SUPPORTING A CATHETER DRAINAGE BAG AND TUBE

[76] Inventor: Mary E. D. Repp, 8560-45 Park La., Dallas, Tex. 75231

[21] Appl. No.: 438,619

[22] Filed: Nov. 2, 1982

[51] Int. Cl.[3] ..... B65B 67/12

[52] U.S. Cl. ..... 248/95

[58] Field of Search ..... 248/95, DIG. 14; 128/275, 294; 297/192, DIG. 4; 24/343

[56] References Cited

U.S. PATENT DOCUMENTS

| | | | |
|---|---|---|---|
| 1,618,573 | 2/1927 | Cole | 24/343 X |
| 2,461,071 | 2/1949 | Mettenleiter | 24/343 X |
| 2,886,036 | 5/1959 | Price | 128/275 |
| 3,251,069 | 5/1966 | Clark | 248/95 X |
| 3,371,897 | 3/1968 | Serany | 248/95 |
| 3,529,598 | 9/1970 | Waldman, Jr. | 128/275 |
| 3,568,965 | 3/1971 | Clark | 248/95 |
| 3,776,231 | 12/1973 | Holbrook | 248/95 X |
| 3,896,809 | 7/1975 | Samuel | 128/275 |
| 4,027,842 | 6/1977 | Mittleman | 248/75 |
| 4,157,152 | 6/1979 | Blastic | 24/343 X |
| 4,179,159 | 12/1979 | Sieklucki | 297/192 |
| 4,312,352 | 1/1982 | Meisch | 128/294 |
| 4,332,252 | 6/1982 | Taylor | 128/275 |

*Primary Examiner*—J. Franklin Foss

*Attorney, Agent, or Firm*—Richards, Harris & Medlock

[57] ABSTRACT

A clip for supporting a catheter drainage bag having upper and lower elongated arms joined by a bend and a hook attached to one end of the lower arm is provided. The upper and lower arms have opposing surfaces spaced to grip the seat of a chair inserted therebetween. Fingers extending from the lower arm of the clip are provided to support a coiled portion of a catheter drainage tube. Also provided is a curved extension from the upper arm for maintaining the tube in a straight and parallel relationship with the clip.

1 Claim, 6 Drawing Figures

APPARATUS FOR SUPPORTING A CATHETER DRAINAGE BAG AND TUBE

TECHNICAL FIELD

The present invention relates to medical devices, and more particularly to a support for a catheter drainage bag and tube.

BACKGROUND ART

Various methods and devices have been proposed for supporting catheter drainage bags and tubes. For example, supports for attaching a bag to a side bar of a hospital bed are shown in U.S. Pat. No. 2,886,036 to Price, U.S. Pat. No. 3,371,897 to Serany, Jr., et al., U.S. Pat. No. 3,529,598 to Waldman, Jr., et al., U.S. Pat. No. 3,568,965 to Clark, U.S. Pat. No. 4,027,842 to Mittleman, U.S. Pat. No. 4,322,352 to Meisch, et al. and U.S. Pat. No. 4,332,252 to Taylor. The devices shown in these patents are not adaptable for use when a patient is sitting in a chair of wheelchair, because these devices are designed for attachment to a bar or bed rail structure.

Several systems for supporting a catheter bag and tube from a wheelchair are known in the art, for example, U.S. Pat. No. 3,896,809 to Samuel, et al. and U.S. Pat. No. 4,179,159 to Sieklucki, et al., but these systems are complicated apparatuses having many expensive specially-manufactured parts. Neither of these systems has come into widespread use.

The commonly used method of supporting a catheter bag and tube from a chair or a wheelchair involves hanging the bag from the back of the chair or wheelchair with a bent coat hanger or string attached to the back of the chair. The coat hanger or string is then connected to the brake handle of the wheelchair. This makeshift method of supporting the bag and tube suffers from numerous drawbacks. The catheter bag is often hung higher than the patient's bladder, such that fluids do not drain from the tubing to the bag. Moreover, with the bag supported near the back of the wheelchair, there is always a danger that the tube will be pulled taut and cause trauma to the patient. The bag is susceptible to being struck by the person pushing the chair. There is also a possibility that the catheter tube will become kinked. When the bag is attached near the side of the wheelchair, there is a danger that the bag will be struck by persons and objects around the chair or be caught in the wheel of the wheelchair.

Another drawback of prior art methods of supporting a drainage tube and bag is that the bag is usually hung at a location where it is visible to others. A location under the center front portion of the seat is preferable, because the bag is obscured by the patient's gown and legs and the privacy of the patient is preserved.

Thus, a need presently exists for a method of supporting a drainage bag and tube from a chair which is simple and inexpensive and which securely, yet removably, supports the drainage bag from the front of the wheelchair seat out of view and away from the wheels and other objects.

SUMMARY OF THE INVENTION

The present invention provides a method and apparatus for supporting a catheter drainage bag and tube underneath the front center portion of a chair seat. The invention includes a clip having elongate opposed arms which grip the front portion of the seat and a hook located at the end of the lower arm for supporting the bag. Alternate embodiments of the invention include structure for holding a coiled portion of the drainage tube and structure for maintaining a portion of the catheter tube straight and parallel to the clip.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
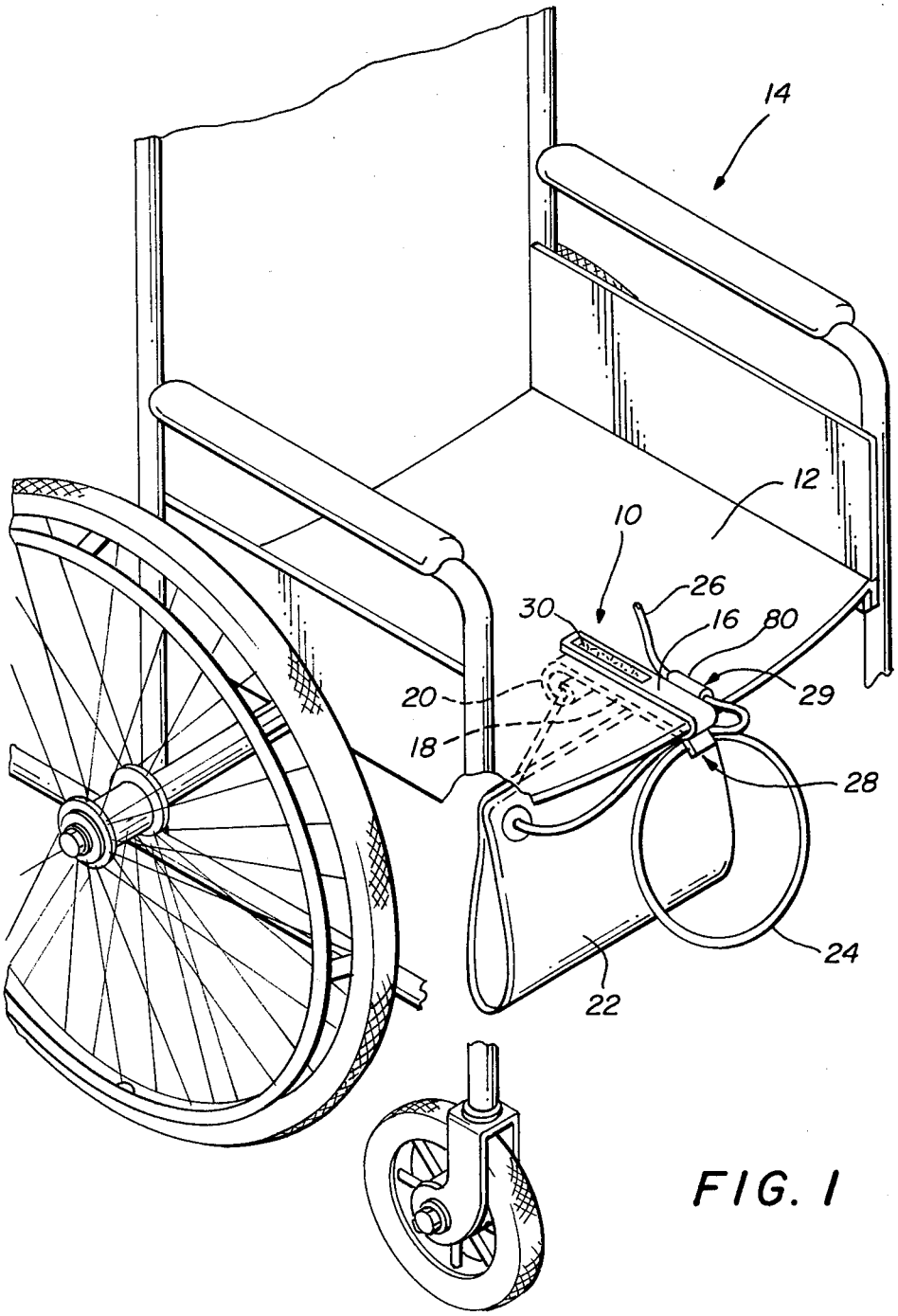
FIG. 1 is a perspective view of a clip constructed in accordance with the present invention attached to a wheelchair seat.

Referring initially to FIG. 1, a clip 10 is attached to seat 12 of wheelchair 14. It will be understood that wheelchair 14 is exemplary of the environment of the invention, and that the present invention may be used with any kind of chair. Clip 10 includes upper arm 16, lower arm 18 (in phantom lines) and hook 20 (in phantom lines). Hook 20 supports drainage bag 22. Coiled portion 24 of drainage tube 26 is supported by tube support 28 attached to clip 10. Tube 26 is loosely retained by tube straightener 29. Nametag 30 is attached to the top surface of upper arm 16.

Referring now to FIGS. 2–6, the details of the clip of the present invention may be more readily appreciated. Clip 10 in the preferred embodiment is constructed of a continuous piece of thermoplastic material. The piece of material is, bent at 180° bend 50, into upper arm 16 and lower arm 18. Upper arm 16 and lower arm 18 are elongated and joined to one another at one end by bend 50. Gap 51 separates upper arm 16 and lower arm 18.

Upper arm 16 includes downwardly-facing surface 52. Lower arm 18 includes upwardly-facing surface 54 opposite surface 52. Surfaces 52 and 54 are in a spaced-apart relationship, being separated by gap 51. Gap 51 is sufficiently narrow to enable surfaces 52 and 54 to grip a seat of a chair placed between the surfaces. In the preferred embodiment, which is intended for use with a wheelchair having a cloth seat, gap 51 is quite narrow, although the width of gap 51 may be chosen to accommodate any type of chair seat. In the drawings, gap 51 is exaggerated in width for clarity. The preferred embodiment of the clip is formed of a continuous piece of material having a rectangular cross-section, and surfaces 52 and 54 are portions of a planar surface of the rectangular material bent to face one another.

Figure 2:
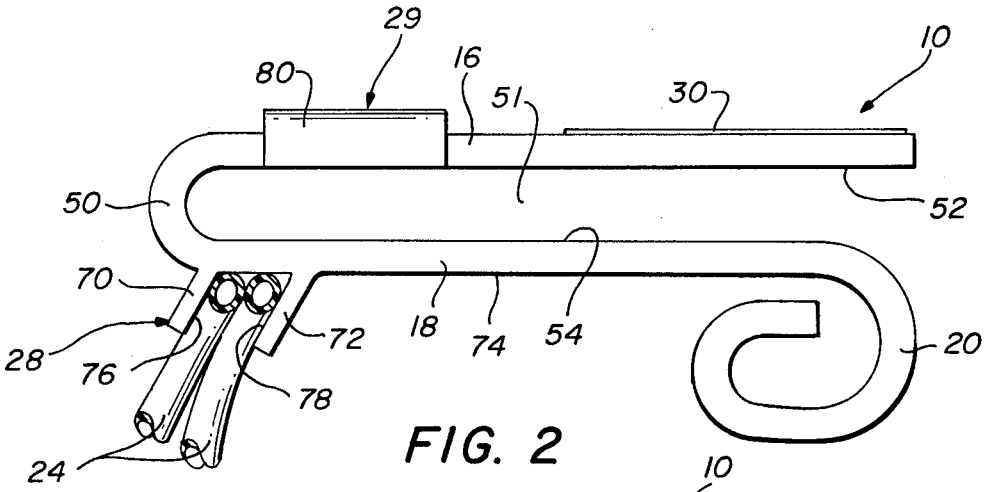
FIG. 2 is a side view of the clip of FIG. 1.
Figure 3:
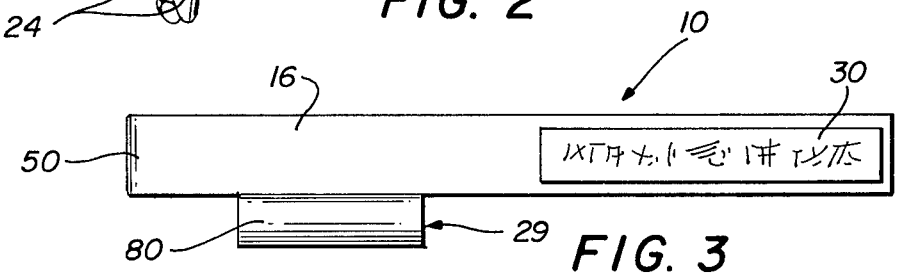
FIG. 3 is a top view of the clip of FIG. 1.
Figure 4:
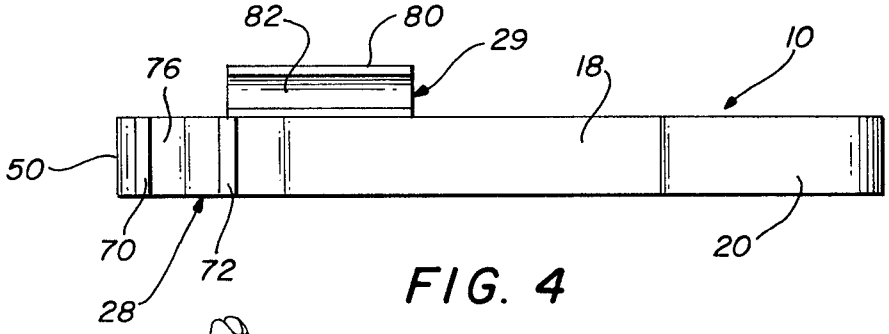
FIG. 4 is a bottom view of the clip of FIG. 1.

Tube support 28 includes fingers 70 and 72 extending in a generally downward direction from outer surface 74 of lower arm 18. Finger 70 includes surface 76 opposite and separated by a gap from surface 78 of finger 72. As shown in FIG. 2, coiled portion 24 of tube 26 may be frictionally engaged by surfaces 76 and 78 such that the coiled portion is supported by fingers 70 and 72.

Figure 5:
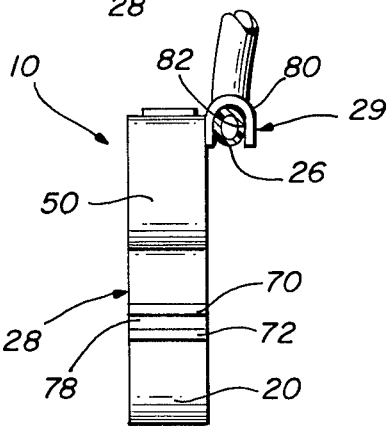
FIG. 5 is an end view of the clip of FIG. 1.
Figure 6:
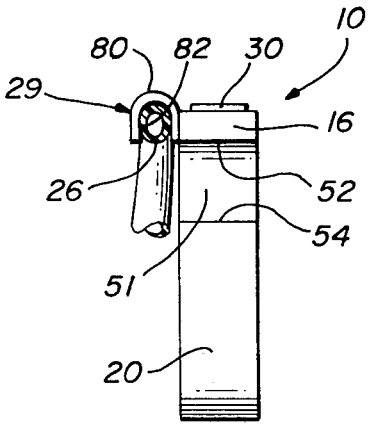
FIG. 6 is an end view of the clip of FIG. 1.

Tube straighteners 29 includes extension 80 projecting from a side of upper arm 16. Extension 80 is semicylindrical and has a longitudinal axis parallel and spaced-apart from upper arm 16. Extension 80 includes inner curved surface 82 concaved downward and dimensioned to retain tube 26, as best shown in FIGS. 5 and 6.

The end of lower arm 18 at the other end from bend 50 is curved to form hook 20. Hook 20 is dimensioned to support a conventional catheter drainage bag.

In use, arms 16 and 18 of clip 10 are spread to slide over the front portion of a chair seat and then released so that opposing surfaces 52 and 54 engage the front center portion of the seat. The drainage bag is then hung from hook 20, which is located at the end of lower arm 18 furthest from the front edge of the chair. This enables the stable support of the catheter drainage bag with the weight of the bag being evenly carried by surface 52 on upper arm 16. Any excess portion of the drainage tube may be coiled and supported by fingers 70 and 72, which are preferably located near the front lower portion of the clip. The excess portion of the tube is thus protected from being stretched or damaged. The portion of the tube to be attached to the patient is maintained in a straight and parallel relationship with the clip by tube straightener 29. Tube straightener 29 minimizes the movement of the tube, thus reducing trauma and infection, and prevents the tube from being compressed by the patient's leg.

While particular embodiments of the present invention have been described in detail herein and shown in the accompanying drawings, it will be evident that various further modifications are possible without departing from the scope of the invention.

I claim:

1. A clip for supporting a catheter drainage bag and tube from a chair comprising:

a body formed of a continuous piece of thermoplastic material;

the body including an upper planar elongated arm and a lower planar elongated arm being joined by a 180° bend into a parallel, spaced-apart relationship and being separated by a gap;

the upper arm including a downwardly-facing planar surface, and the lower arm including an upwardly facing surface separated by the gap from the upwardly-facing surface;

the end of the lower arm being curved to form a hook for supporting a catheter drainage bag;

a pair of fingers extending outwardly from the body having opposed planar surfaces being separated by a gap for frictionally engaging at least two sections of a coiled catheter drainage tube associated with the catheter drainage bag; and a semi-cylindrical tube straightener attached to the upper arm of the body having a longitudinal axis parallel and spaced apart from the upper arm of the body for maintaining a portion of the catheter drainage tube in a straight and parallel relationship with the clip.

* * * * *